US010098421B2

(12) United States Patent
Lin

(10) Patent No.: US 10,098,421 B2
(45) Date of Patent: Oct. 16, 2018

(54) ZIPPER HEAD ASSEMBLY STRUCTURE AND SLIDING MEMBER THEREOF

(71) Applicant: CHUNG CHWAN ENTERPRISE CO., LTD., Taoyuan (TW)

(72) Inventor: Yu-Pau Lin, Taoyuan (TW)

(73) Assignee: CHUNG CHWAN ENTERPRISE CO., LTD., Taoyuan (TW)

( * ) Notice: Subject to any disclaimer, the term of this patent is extended or adjusted under 35 U.S.C. 154(b) by 5 days.

(21) Appl. No.: 15/454,163

(22) Filed: Mar. 9, 2017

(65) Prior Publication Data

US 2017/0172263 A1 Jun. 22, 2017

Related U.S. Application Data

(63) Continuation-in-part of application No. 15/011,707, filed on Feb. 1, 2016.

(30) Foreign Application Priority Data

Nov. 30, 2015 (TW) ..... 104139896 A

(51) Int. Cl.
*A44B 19/26* (2006.01)
*A44B 19/30* (2006.01)

(52) U.S. Cl.
CPC ..... *A44B 19/262* (2013.01); *A44B 19/303* (2013.01)

(58) Field of Classification Search
CPC ..... A44B 19/262; A44B 19/303
See application file for complete search history.

(56) References Cited

U.S. PATENT DOCUMENTS 4,980,954 A * 1/1991 Takabatake ..... A44B 19/26 24/419
5,625,928 A * 5/1997 Terada ..... A44B 19/308 24/421
2005/0076480 A1* 4/2005 Chen ..... A44B 19/306 24/415
2011/0041297 A1* 2/2011 Iwase ..... A44B 19/306 24/418
2013/0174387 A1* 7/2013 Hamada ..... A44B 19/306 24/418
2014/0033484 A1* 2/2014 Hamada ..... A44B 19/26 24/418
2015/0313321 A1* 11/2015 Miyazaki ..... A44B 19/308 24/429

* cited by examiner

*Primary Examiner* — David M Upchurch
(74) *Attorney, Agent, or Firm* — Li & Cai Intellectual Property (USA) Office

(57) ABSTRACT

A sliding member is provided, the sliding member includes a first sliding body, a second sliding body opposite to the first sliding body, a connection body connected between the first sliding body and the second sliding body, a first convex body disposed on the first sliding body, and a second convex body disposed on the first sliding body. The first convex body has two convex ribs and two convex portions disposed on a top side of the first sliding body to respectively adjacent to the two convex ribs. A movable cover body has two sliding portions respectively movably contacting the two convex ribs and respectively separately contacting the two convex portions. A zipper head assembly structure using the sliding member is further provided.

11 Claims, 11 Drawing Sheets

Z

Z

ZIPPER HEAD ASSEMBLY STRUCTURE AND SLIDING MEMBER THEREOF

CROSS REFERENCE TO RELATED APPLICATION

This application is a continuation-in-part of U.S. application Ser. No. 15/011,707, filed on Feb. 1, 2016 and entitled "zipper head assembly structure for decreasing assembling resistance and movable cover body thereof", now pending, the entire disclosures of which are incorporated herein by reference.

FIELD OF THE INVENTION

The instant disclosure relates to a assembly structure and a sliding member thereof, and more particularly to a zipper head assembly structure and a sliding member thereof.

BACKGROUND OF THE INVENTION

In general, zippers are basic elements in clothing or accessories. Compare to buttons, the zippers are easier to use. A conventional zipper comprises a zipper head and a tape. The zipper head works with the tape to allow the pulling action. Recently, the zipper has been used commonly for clothing, pants, backpack, and other accessories.

SUMMARY OF THE INVENTION

One aspect of the instant disclosure relates to a zipper head assembly structure and a sliding member thereof.

One of the embodiments of the instant disclosure provides a zipper head assembly structure, comprising: a sliding member, a movable cover body, and a pull member. The sliding member has a first sliding body, a second sliding body opposite to the first sliding body, and a connection body connected between the first sliding body and the second sliding body. The movable cover body is movably disposed on the first sliding body. The pull member has an end portion movably mated with the movable cover body.

Another one of the embodiments of the instant disclosure provides a zipper head assembly structure, comprising: a sliding member, a movable cover body, and a pull member. The movable cover body is movably disposed on the first sliding body, and the pull member has an end portion movably mated with the movable cover body. More precisely, the sliding member has a first convex body disposed on the first sliding body and a second convex body disposed on the first sliding body and corresponding to the first convex body, and the second convex body has a second main portion disposed on the first sliding body, two pivotal grooves respectively disposed on two opposite lateral sides of the second main portion, and two inclined assembly surfaces respectively disposed on the two opposite lateral sides of the second main portion and respectively disposed above the two pivotal grooves. The movable cover body has a major portion, two pivotal portions extended outwardly from the major portion and respectively pivotally disposed inside two pivotal grooves, and two assembly chamfers respectively disposed on two inner corners of the two pivotal portions and respectively corresponding to the two inclined assembly surfaces.

Yet another one of the embodiments of the instant disclosure provides a sliding member, comprising: a first sliding body, a second sliding body opposite to the first sliding body, a connection body connected between the first sliding body and the second sliding body, a first convex body disposed on the first sliding body, and a second convex body disposed on the first sliding body. The first convex body has two convex ribs and two convex portions disposed on a top side of the first sliding body to respectively adjacent to the two convex ribs, and a movable cover body has two sliding portions respectively movably contacting the two convex ribs and respectively separately contacting the two convex portions.

Because the designs of "the two pivotal portions extended outwardly from the major portion and respectively pivotally disposed inside the two pivotal grooves" and "the two assembly chamfers respectively disposed on two inner corners of the two pivotal portions and respectively corresponding to the two inclined assembly surfaces", the assembling resistance of assembling the movable cover body on the sliding member is decreased due to the low-resistance surface contact between the assembly chamfer and the inclined assembly surface, so as to prevent the sliding member from being scraped by the movable cover body. Hence, the two assembly chamfers can respectively slip through the two inclined assembly surfaces easily in order to assemble the movable cover body on the sliding member.

To further understand the techniques, means and effects of the instant disclosure applied for achieving the prescribed objectives, the following detailed descriptions and appended drawings are hereby referred to, such that, and through which, the purposes, features and aspects of the instant disclosure can be thoroughly and concretely appreciated. However, the appended drawings are provided solely for reference and illustration, without any intention to limit the instant disclosure.

DETAILED DESCRIPTION OF THE PREFERRED EMBODIMENTS

The embodiments of a zipper head assembly structure and a sliding member thereof of the instant disclosure are described. Other advantages and objectives of the instant disclosure can be easily understood by one skilled in the art from the disclosure. The instant disclosure can be applied in different embodiments. Various modifications and variations can be made to various details in the description for different applications without departing from the scope of the instant disclosure. The drawings of the instant disclosure are provided only for simple illustrations, but are not drawn to scale and do not reflect the actual relative dimensions. The following embodiments are provided to describe in detail the concept of the instant disclosure, and are not intended to limit the scope thereof in any way.

Referring to FIG. 1 to FIG. 8, the instant disclosure provides a zipper head assembly structure Z, comprising: a sliding member 1 (such as a sliding head or a slide fastener head), a movable cover body 2, and a pull member 3 (such as a pull tab or a pull piece).

Figure 1:
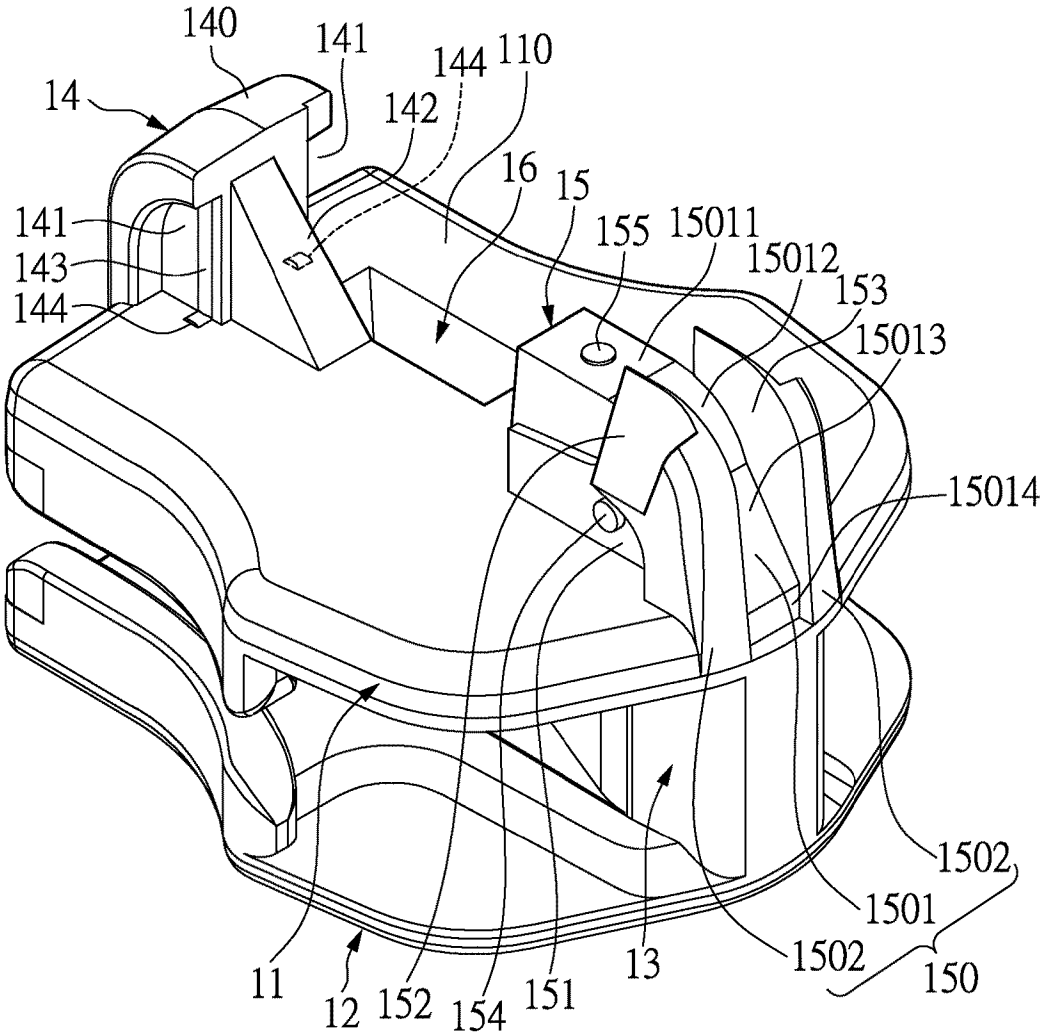
FIG. 1 shows a perspective, schematic view of the sliding member of the zipper head assembly structure according to the instant disclosure.
Figure 2:
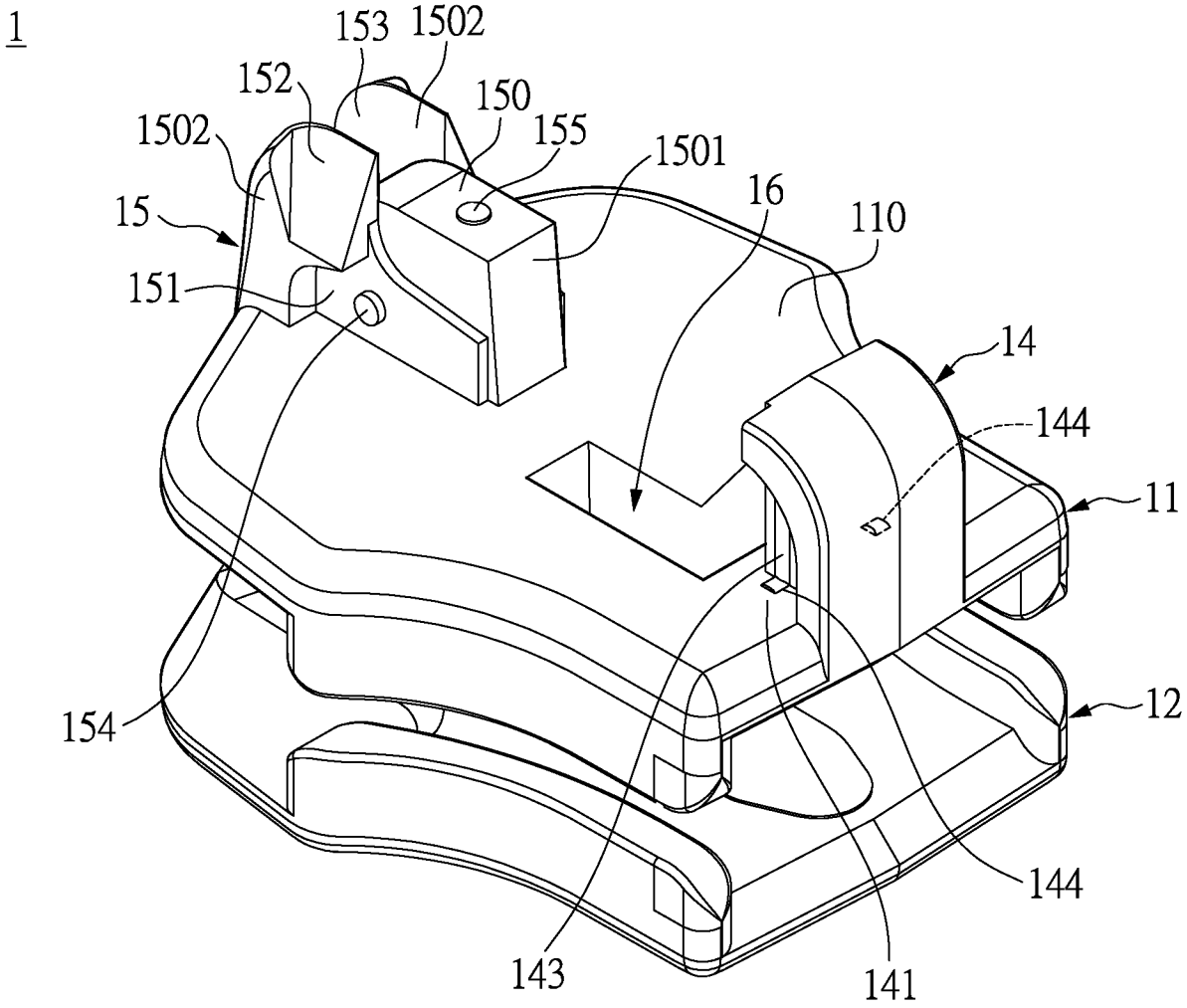
FIG. 2 shows another perspective, schematic view of the sliding member of the zipper head assembly structure according to the instant disclosure.

First, referring to FIG. 1 and FIG. 2, the sliding member 1 has a first sliding body 11, a second sliding body 12 opposite to the first sliding body 11, and a connection body 13 connected between the first sliding body 11 and the second sliding body 12. More precisely, the sliding member 1 has a first convex body 14 disposed on the first sliding body 11, a second convex body 15 disposed on the first sliding body 11 and corresponding to the first convex body 14, and at least one through opening 16 passing through the first sliding body 11 and disposed between the first convex body 14 and the second convex body 15. In addition, the first convex body 14 has a first main portion 140 disposed on the first sliding body 11, two sliding grooves 141 respectively disposed on two opposite lateral sides of the first main portion 140, and at least one structure reinforcing rib 142 disposed on the first sliding body 11 and connected with the first main portion 140. Moreover, the second convex body 15 has a second main portion 150 disposed on the first sliding body 11, two pivotal grooves 151 respectively disposed on two opposite lateral sides of the second main portion 150, two inclined assembly surfaces 152 respectively disposed on the two opposite lateral sides of the second main portion 150 and respectively disposed above the two pivotal grooves 151, and a receiving groove 153 disposed on the second main portion 150 and extended onto a front side of the second main portion 150.

Following the above description, for example, the second main portion 150 has a carrier body 1501 and two lateral walls 1502 respectively disposed on two opposite lateral sides of the carrier body 1501. In addition, the carrier body 1501 has a first surface 15011, a second surface 15012 connected with the first surface 15011, a third surface 15013 connected with the second surface 15012, and a fourth surface 15014 connected with the third surface 15013 and disposed on the front side of the second main portion 150. The receiving groove 153 is disposed on the carrier body 1501 and between the two lateral walls 1502, and the two inclined assembly surfaces 152 are respectively inclinedly disposed on the two lateral walls 1502.

Figure 3:
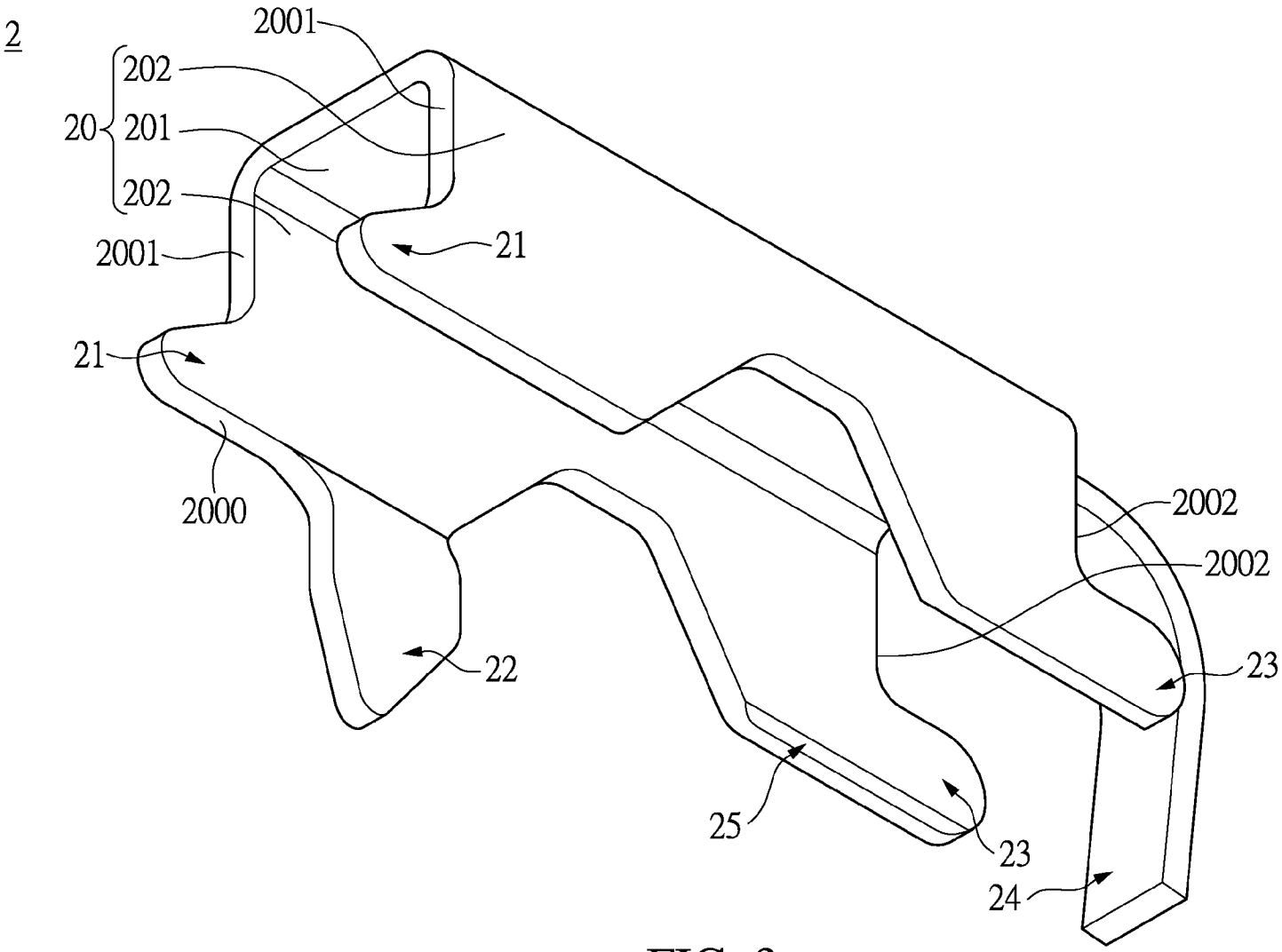
FIG. 3 shows a perspective, schematic view of the movable cover body of the zipper head assembly structure according to the instant disclosure.
Figure 4:
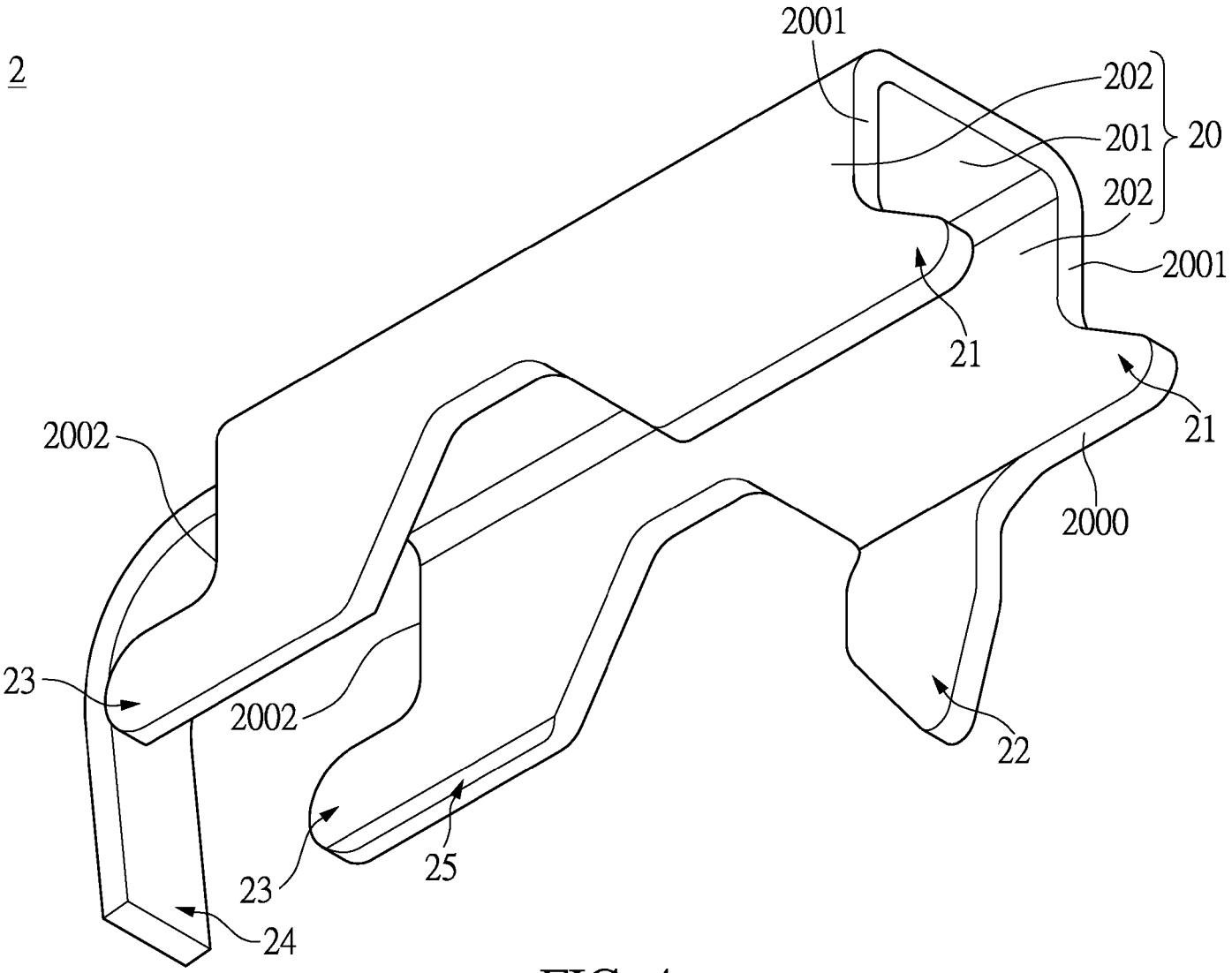
FIG. 4 shows another perspective, schematic view of the movable cover body of the zipper head assembly structure according to the instant disclosure.
Figure 5:
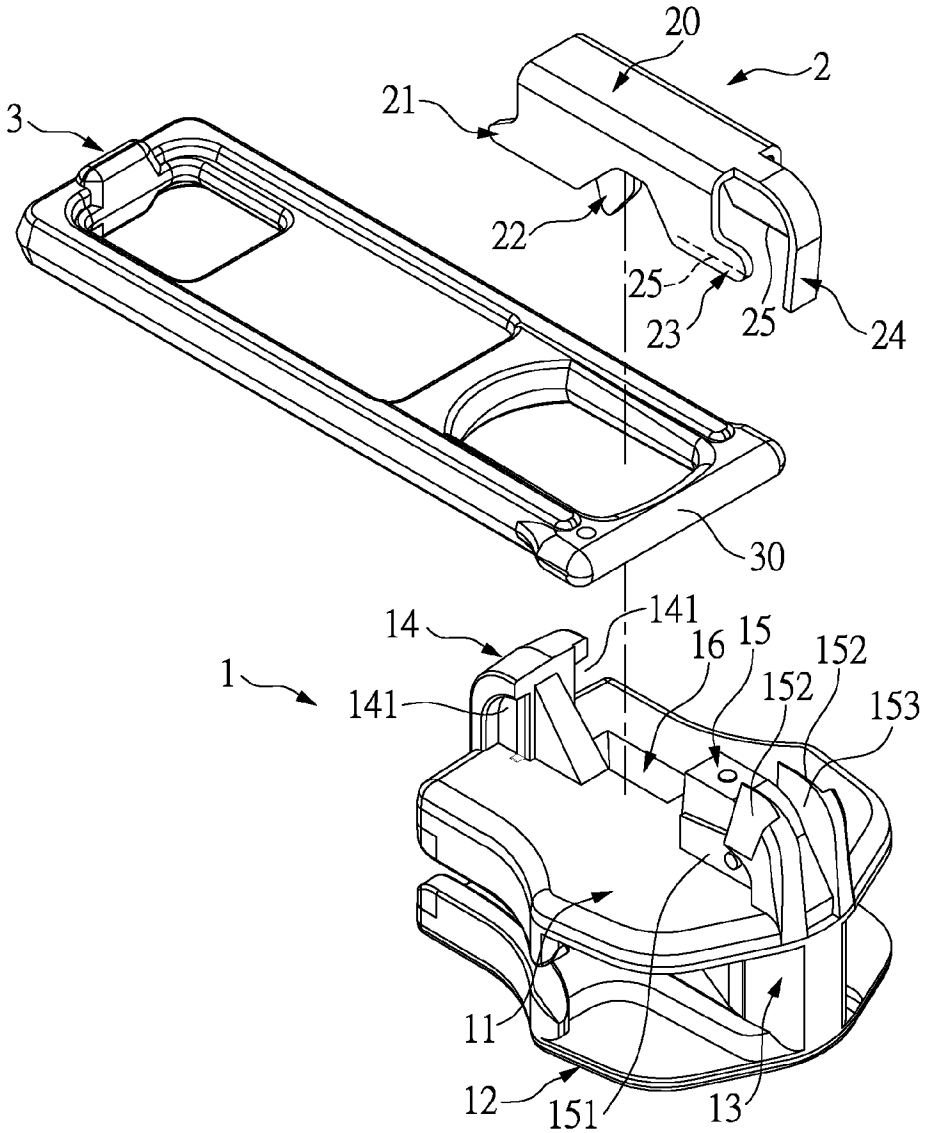
FIG. 5 shows a perspective, exploded, schematic view of the zipper head assembly structure according to the instant disclosure.
Figure 6:
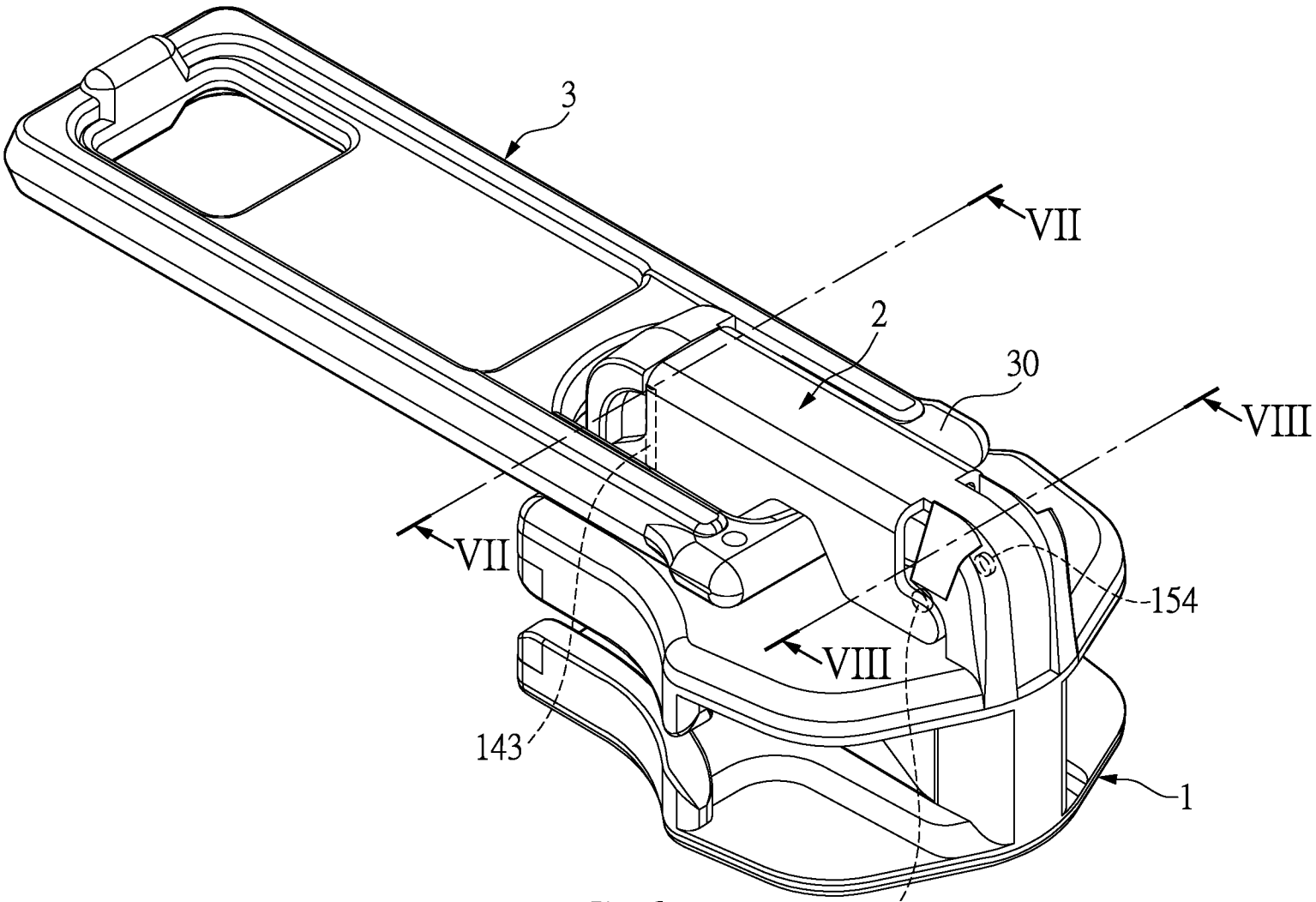
FIG. 6 shows a perspective, assembled, schematic view of the zipper head assembly structure according to the instant disclosure.
Figure 7:
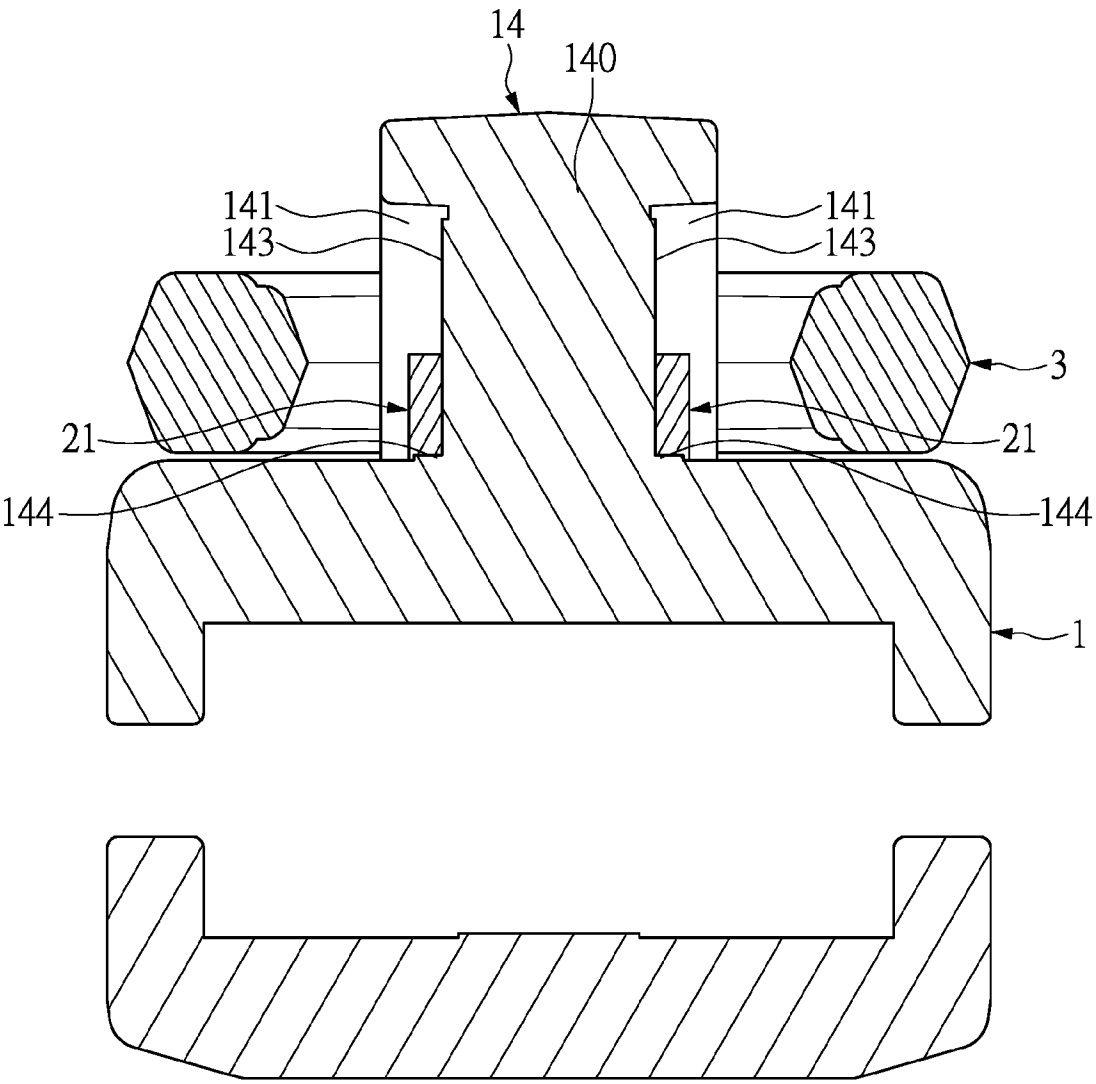
FIG. 7 shows a cross-sectional view taken along the section line VII-VII of FIG. 6.
Figure 8:
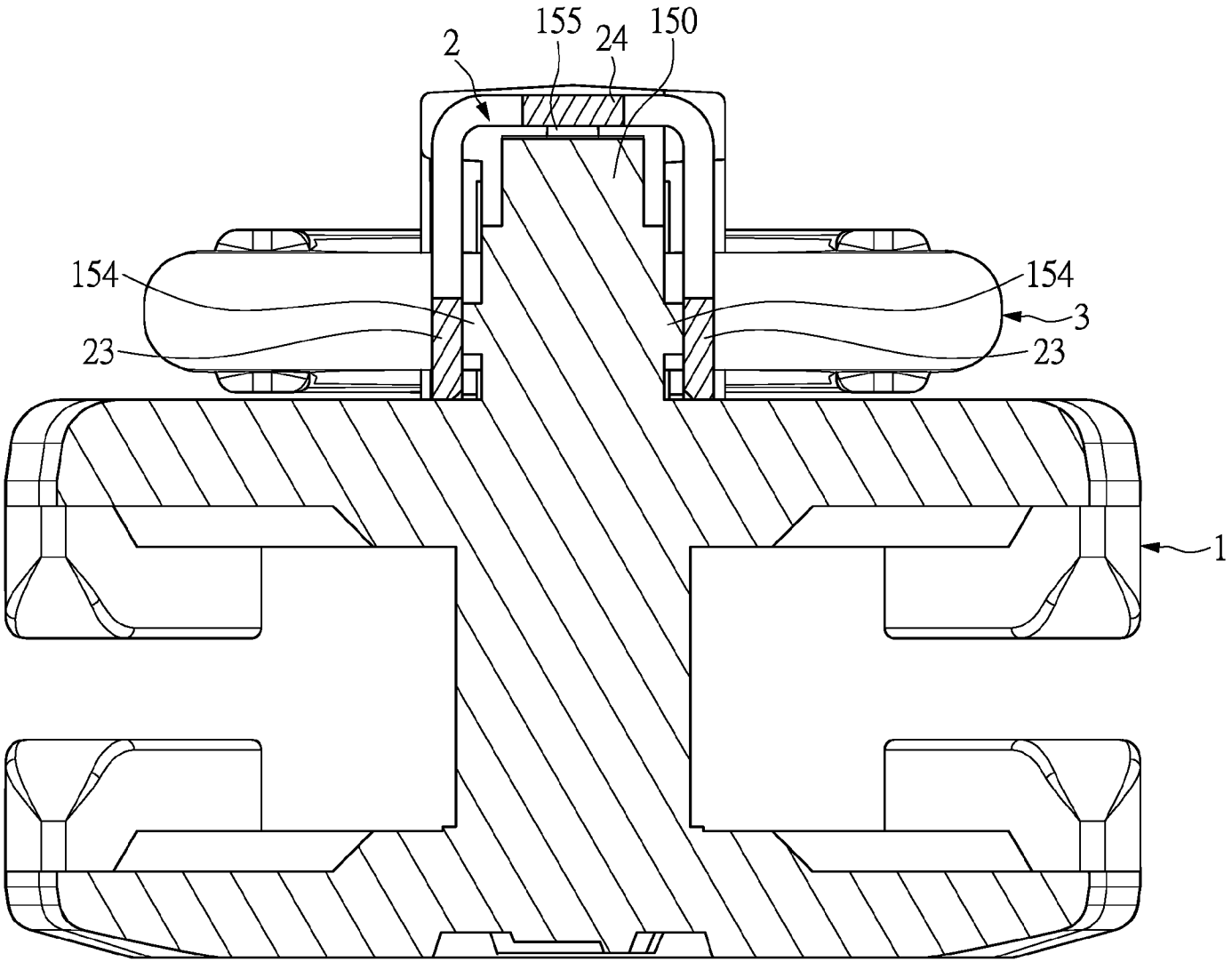
FIG. 8 shows a cross-sectional view taken along the section line VIII-VIII of FIG. 6.

Moreover, referring to FIG. 3, FIG. 4, and FIG. 5, the movable cover body 2 is movably disposed on the first sliding body 11, and the pull member 3 has an end portion 30 movably mated with the movable cover body 2. In addition, the movable cover body 2 has a major portion 20, two sliding portions 21 extended outwardly from the major portion 20 and respectively slidably disposed inside the two sliding grooves 141, a positioning portion 22 extended outwardly from the major portion 20 and movably passing through the through opening 16, two pivotal portions 23 extended outwardly from the major portion 20 and respectively pivotally disposed inside the two pivotal grooves 151, an extending tail portion 24 extended outwardly from the major portion 20 and disposed inside the receiving groove 153, and two assembly chamfers 25 (such as two assembly bevels) respectively disposed on two inner corners of the two pivotal portions 23 and respectively corresponding to the two inclined assembly surfaces 152. For example, the inclined assembly surface 152 has a first predetermined inclination such as 45 degrees relative to the horizontal surface, the assembly chamfer 25 has a second predetermined inclination such as 45 degrees relative to the horizontal surface. When the first predetermined inclination is the same as or similar to the second predetermined inclination, the assembling resistance between the assembly chamfer 25 and the inclined assembly surface 152 is decreased. Hence, the two assembly chamfers 25 can respectively slip through the two inclined assembly surfaces 152 easily in order to assemble the movable cover body 2 on the sliding member 1.

More precisely, referring to FIG. 1 and FIG. 2, the major portion 20 has a first plane plate 201 and two second plane plates 202 respectively extended downwardly from the two opposite lateral sides of the first plane plate 201. The two sliding portions 21 are respectively extended outwardly from two first lateral sides 2001 of the two second plane plates 202, the positioning portion 22 is extended downwardly from a bottom side 2000 of one of the two second plane plates 202, the two pivotal portions 23 are respectively extended outwardly from two second lateral sides 2002 of the two second plane plates 202, and the extending tail portion 24 is extended downwardly from an end side of the first plane plate 201.

Figure 9:
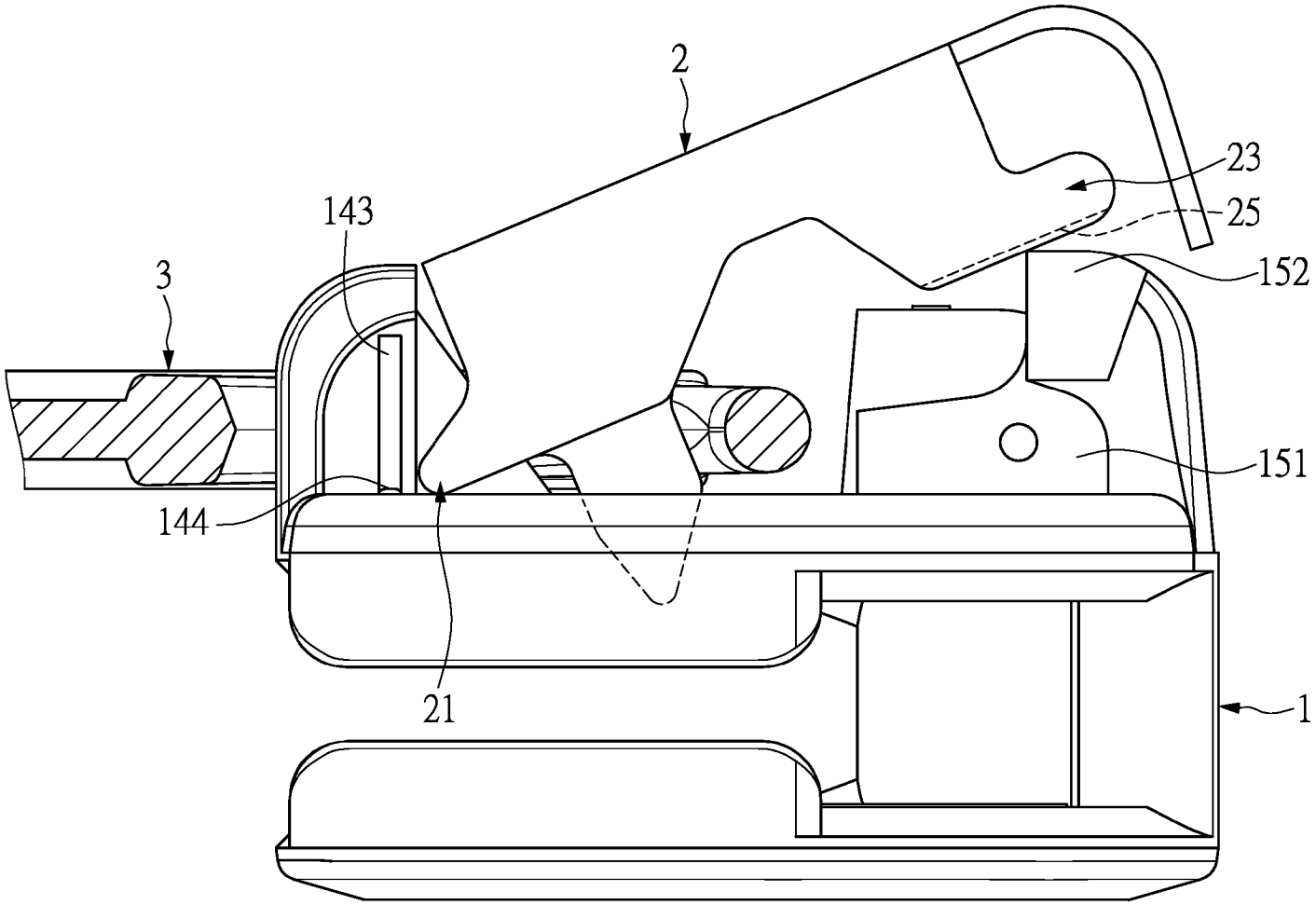
FIG. 9 shows a partial, lateral, schematic view of the movable cover body of the zipper head assembly structure preparing to be assembled on the sliding member (that is to say that the assembly chamfer prepares to contact the inclined assembly surface) according to the instant disclosure.
Figure 10:
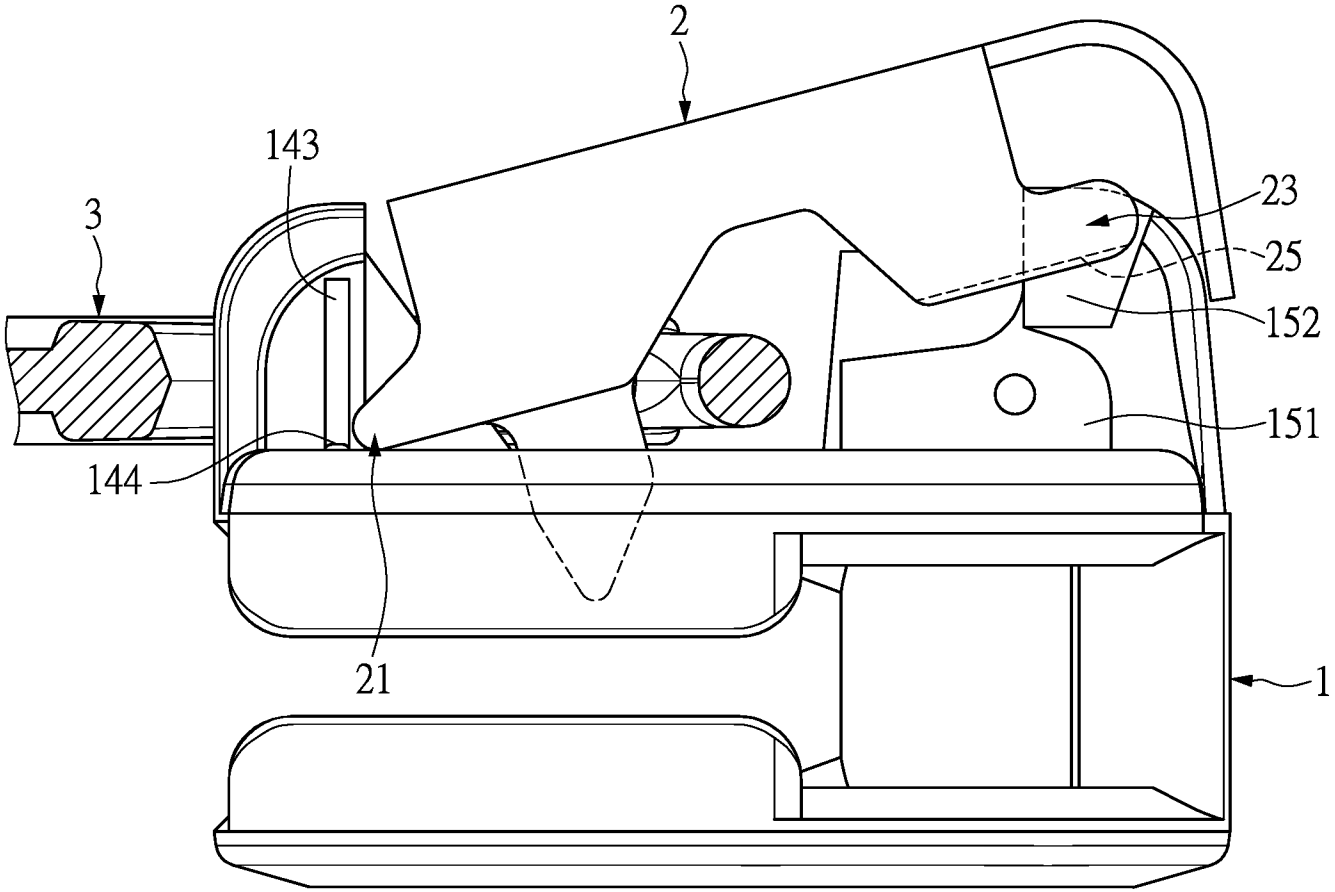
FIG. 10 shows a partial, lateral, schematic view of the movable cover body of the zipper head assembly structure slipping on the sliding member (that is to say that the assembly chamfer has contacted the inclined assembly surface) according to the instant disclosure.
Figure 11:
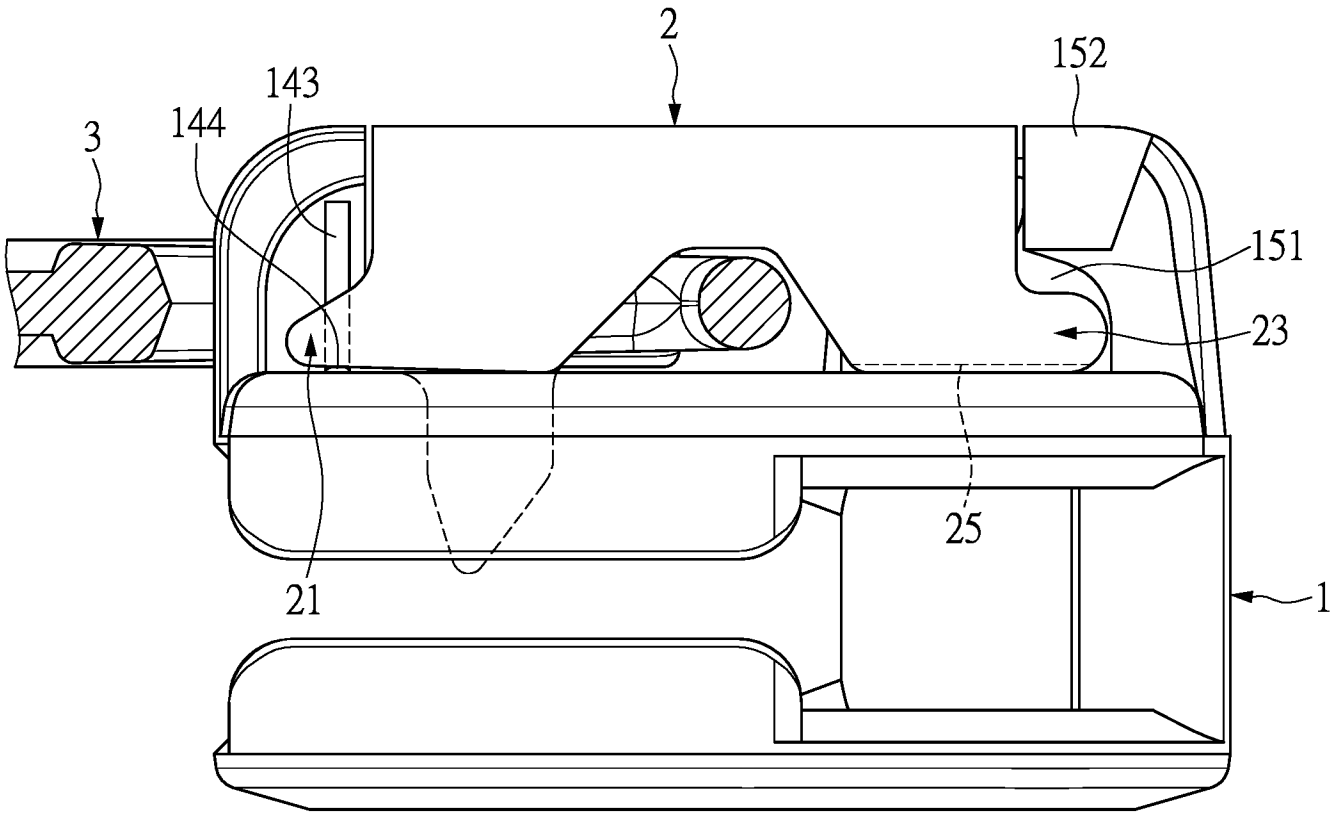
FIG. 11 shows a partial, lateral, schematic view of the movable cover body of the zipper head assembly structure having been assembled on the sliding member (that is to say that the assembly chamfer has slipped through the inclined assembly surface) according to the instant disclosure.

More precisely, referring to FIG. 1, FIG. 2, FIG. 6, and FIG. 7, the first convex body 14 has two vertical convex ribs 143 respectively disposed inside the two sliding grooves 141, and two convex portions 144 disposed on a top side 110 of the first sliding body 11 to respectively connect to the two vertical convex ribs 143, and the two sliding portions 21 respectively movably contact the two vertical convex ribs 143 so as to decrease the friction resistance between the first convex body 14 and the movable cover body 2. The two sliding portions 21 respectively separately contact the two convex portions 144 as shown in FIG. 9 to FIG. 11, so that the two sliding portions 21 are respectively supported by the two convex portions 144 so as to decrease the contacting area between the sliding portion 21 and the top side 110 of the first sliding body 11. It should be noted that each convex portion 144 has a curved surface contacting the corresponding sliding portion 21, so that the two sliding portions 21 can respectively separately contact the two curved surfaces of the two convex portions 144 so as to decrease the contacting area between the sliding portion 21 and the two convex portion 144. Referring to FIG. 1, FIG. 2, FIG. 6, and FIG. 8, the second convex body 15 has two first convex points 154 respectively disposed inside the two pivotal grooves 151, and the two pivotal portions 23 respectively movably contact the two first convex points 154. In addition, the second convex body 15 has at least one second convex point 155 disposed inside the receiving groove 153, and the extending tail portion 24 movably contacts the at least one second convex point 155.

Referring to FIG. 9, FIG. 10, and FIG. 11, FIG. 9 shows a partial, lateral, schematic view of the movable cover body 2 of the zipper head assembly structure Z preparing to be assembled on the sliding member 1 (that is to say that the assembly chamfer 25 prepares to contact the inclined assembly surface 152) according to the instant disclosure, FIG. 10 shows a partial, lateral, schematic view of the movable cover body 2 of the zipper head assembly structure Z slipping on the sliding member 1 (that is to say that the assembly chamfer 25 has contacted the inclined assembly surface 152) according to the instant disclosure, and FIG. 11 shows a partial, lateral, schematic view of the movable cover body 2 of the zipper head assembly structure Z having been assembled on the sliding member 1 (that is to say that the assembly chamfer 25 has slipped through the inclined assembly surface 152) according to the instant disclosure. Referring to FIG. 9 and FIG. 10, the assembling resistance of assembling the movable cover body 2 on the sliding member 1 is decreased due to the low-resistance surface contact between the assembly chamfer 25 and the inclined assembly surface 152, so as to prevent the sliding member 1 from being scraped by the movable cover body 2. Hence, the two assembly chamfers 25 can respectively slip through the two inclined assembly surfaces 152 easily in order to assemble the movable cover body 2 on the sliding member 1.

In conclusion, Because the designs of "the two pivotal portions 23 extended outwardly from the major portion 20 and respectively pivotally disposed inside the two pivotal grooves 151" and "the two assembly chamfers 25 respectively disposed on two inner corners of the two pivotal portions 23 and respectively corresponding to the two inclined assembly surfaces 152", the assembling resistance of assembling the movable cover body 2 on the sliding member 1 is decreased due to the low-resistance surface contact between the assembly chamfer 25 and the inclined assembly surface 152, so as to prevent the sliding member 1 from being scraped by the movable cover body 2.

For example, the inclined assembly surface 152 has a first predetermined inclination such as 45 degrees relative to the horizontal surface, the assembly chamfer 25 has a second predetermined inclination such as 45 degrees relative to the horizontal surface. When the first predetermined inclination is the same as or similar to the second predetermined inclination, the assembling resistance between the assembly chamfer 25 and the inclined assembly surface 152 is decreased. Hence, the two assembly chamfers 25 can respectively slip through the two inclined assembly surfaces 152 easily in order to assemble the movable cover body 2 on the sliding member 1.

The aforementioned descriptions merely represent the preferred embodiments of the instant disclosure, without any intention to limit the scope of the instant disclosure which is fully described only within the following claims. Various equivalent changes, alterations or modifications based on the claims of the instant disclosure are all, consequently, viewed as being embraced by the scope of the instant disclosure.

What is claimed is:

1. A zipper head assembly structure, comprising:

a sliding member having a first sliding body, a second sliding body opposite to the first sliding body, and a connection body connected between the first sliding body and the second sliding body;

a movable cover body movably disposed on the first sliding body; and a pull member having an end portion movably mated with the movable cover body;

wherein the sliding member has a first convex body disposed on the first sliding body, a second convex body disposed on the first sliding body and corresponding to the first convex body, and at least one through opening passing through the first sliding body and disposed between the first convex body and the second convex body, the first convex body has a first main portion disposed on the first sliding body, two sliding grooves respectively disposed on two opposite lateral sides of the first main portion, and at least one structure reinforcing rib disposed on the first sliding body and connected with the first main portion, and the second convex body has a second main portion disposed on the first sliding body, two pivotal grooves respectively disposed on two opposite lateral sides of the second main portion, two inclined assembly surfaces respectively disposed on the two opposite lateral sides of the second main portion exteriorly and respectively disposed above the two pivotal grooves, and a receiving groove disposed on the second main portion and extended onto a front side of the second main portion;

wherein the movable cover body has a major portion, two sliding portions extended outwardly from the major portion and respectively slidably disposed inside the two sliding grooves, a positioning portion extended outwardly from the major portion and movably passing through the through opening, two pivotal portions extended outwardly from the major portion and respectively pivotally disposed inside the two pivotal grooves, an extending tail portion extended outwardly from the major portion and disposed inside the receiving groove, and two assembly chamfers respectively disposed on two inner corners of the two pivotal portions and respectively corresponding to the two inclined assembly surfaces and engaging with the two pivotal grooves exteriorly.

2. The zipper head assembly structure of claim 1, wherein the first convex body has two vertical convex ribs respectively disposed inside the two sliding grooves, and two convex portions disposed on a top side of the first sliding body to respectively connect to the two vertical convex ribs, and the two sliding portions respectively movably contact the two vertical convex ribs and respectively separately contact the two convex portions; wherein the second convex body has two first convex points respectively disposed inside the two pivotal grooves, and the two pivotal portions respectively movably contact the two first convex points, wherein the second convex body has at least one second convex point disposed inside the receiving groove, and the extending tail portion movably contacts the at least one second convex point.

3. The zipper head assembly structure of claim 1, wherein the major portion has a first plane plate and two second plane plates respectively extended downwardly from the two opposite lateral sides of the first plane plate, the two sliding portions are respectively extended outwardly from two first lateral sides of the two second plane plates, the positioning portion is extended downwardly from a bottom side of one of the two second plane plates, the two pivotal portions are respectively extended outwardly from two second lateral sides of the two second plane plates, and the extending tail portion is extended downwardly from an end side of the first plane plate.

4. The zipper head assembly structure of claim 1, wherein the second main portion has a carrier body and two lateral walls respectively disposed on two opposite lateral sides of the carrier body, and the carrier body has a first surface, a second surface connected with the first surface, a third surface connected with the second surface, and a fourth surface connected with the third surface, wherein the receiving groove is disposed on the carrier body and between the two lateral walls, and the two inclined assembly surfaces are respectively inclinedly disposed on the two lateral walls.

5. A zipper head assembly structure, comprising:

a sliding member having a first sliding body;

a movable cover body movably disposed on the first sliding body; and a pull member having an end portion movably mated with the movable cover body;

wherein the sliding member has a first convex body disposed on the first sliding body and a second convex body disposed on the first sliding body and corresponding to the first convex body, and the second convex body has a second main portion disposed on the first sliding body, two pivotal grooves respectively disposed on two opposite lateral sides of the second main portion, and two inclined assembly surfaces respectively disposed on the two opposite lateral sides of the second main portion exteriorly and respectively disposed above the two pivotal grooves;

wherein the movable cover body has two pivotal portions respectively pivotally disposed inside the two pivotal grooves, and two assembly chamfers respectively disposed on two inner corners of the two pivotal portions and respectively corresponding to the two inclined assembly surfaces and engaging with the two pivotal grooves exteriorly.

6. The zipper head assembly structure of claim 5, wherein the movable cover body has a major portion, two pivotal portions extended outwardly from the major portion and respectively pivotally disposed inside two pivotal grooves, and two assembly chamfers respectively disposed on two inner corners of the two pivotal portions and respectively corresponding to the two inclined assembly surfaces.

7. The zipper head assembly structure of claim 6, wherein the first convex body has two vertical convex ribs respectively disposed inside the two sliding grooves, and two convex portions disposed on a top side of the first sliding body to respectively connect to the two vertical convex ribs, and the two sliding portions respectively movably contact the two vertical convex ribs and respectively separately contact the two convex portions; wherein the second convex body has two first convex points respectively disposed inside the two pivotal grooves, and the two pivotal portions respectively movably contact the two first convex points.

8. The zipper head assembly structure of claim 6, wherein the major portion has a first plane plate and two second plane plates respectively extended downwardly from the two opposite lateral sides of the first plane plate, and the two pivotal portions are respectively extended outwardly from two second lateral sides of the two second plane plates.

9. The zipper head assembly structure of claim 6, wherein the second main portion has a carrier body and two lateral walls respectively disposed on two opposite lateral sides of the carrier body, the carrier body has a first surface, a second surface connected with the first surface, a third surface connected with the second surface, and a fourth surface connected with the third surface, and the two inclined assembly surfaces are respectively inclinedly disposed on the two lateral walls.

10. A sliding member, comprising:

a first sliding body;

a second sliding body opposite to the first sliding body;

a connection body connected between the first sliding body and the second sliding body;

a first convex body disposed on the first sliding body; and a second convex body disposed on the first sliding body;

wherein the first convex body has two convex ribs and two convex portions disposed on a top side of the first sliding body to respectively adjacent to the two convex ribs, and a movable cover body has two sliding portions respectively movably contacting the two convex ribs and respectively separately contacting the two convex portions.

11. The movable cover body of claim 10, wherein each convex portion has a curved surface contacting the corresponding sliding portion.

* * * * *